US008864459B2

(12) United States Patent
Casavant et al.

(10) Patent No.: US 8,864,459 B2
(45) Date of Patent: Oct. 21, 2014

(54) TURBINE CASING ASSEMBLY MOUNTING PIN

(75) Inventors: Matthew Stephen Casavant, Greenville, SC (US); Kenneth Damon Black, Travelers Rest, SC (US)

(73) Assignee: General Electric Company, Schenectady, NY (US)

( * ) Notice: Subject to any disclaimer, the term of this patent is extended or adjusted under 35 U.S.C. 154(b) by 703 days.

(21) Appl. No.: 13/226,847

(22) Filed: Sep. 7, 2011

(65) Prior Publication Data

US 2013/0058780 A1 Mar. 7, 2013

(51) Int. Cl.
*F01D 25/26* (2006.01)
*F01D 25/24* (2006.01)

(52) U.S. Cl.
CPC ..... *F01D 25/243* (2013.01)
USPC ..... 415/213.1; 415/220

(58) Field of Classification Search
USPC ..... 415/213.1, 230; 411/511, 513, 922; 403/16, 19, 259, 207, 408.1
See application file for complete search history.

(56) References Cited

U.S. PATENT DOCUMENTS

| | | | | |
|---|---|---|---|---|
| 3,083,863 | A * | 4/1963 | Sees | 220/683 |
| 4,585,390 | A * | 4/1986 | Pirtle et al. | 415/160 |
| 4,832,574 | A * | 5/1989 | Woodwell et al. | 416/244 A |
| 5,271,714 | A | 12/1993 | Shepherd et al. | |
| 6,224,332 | B1 | 5/2001 | Leach et al. | |
| 6,402,468 | B1 | 6/2002 | Florin et al. | |
| 6,457,936 | B1 | 10/2002 | Leach et al. | |
| 7,520,721 | B2 | 4/2009 | Hamlin et al. | |
| 7,581,922 | B1 * | 9/2009 | Morimoto et al. | 415/126 |
| 8,047,781 | B2 * | 11/2011 | Sullivan et al. | 415/214.1 |
| 2007/0041833 | A1 | 2/2007 | Dupin et al. | |
| 2009/0232651 | A1 | 9/2009 | Ballard, Jr. et al. | |
| 2010/0284792 | A1 | 11/2010 | Ballard, Jr. et al. | |

* cited by examiner

*Primary Examiner* — Igor Kershteyn
*Assistant Examiner* — Woody A Lee, Jr.
(74) *Attorney, Agent, or Firm* — Dority & Manning, P.A.

(57) ABSTRACT

In certain embodiments of the present disclosure, a turbine casing assembly is described. The turbine casing assembly includes an inner casing and an outer casing surrounding the inner casing. The outer casing has a first outer casing section and a second outer casing section that join together along a flange. A bolt extends through the flange and joins together the first outer casing section and the second outer casing section. The turbine casing assembly further includes a pin. The pin has a segment defining an opening therethrough. The pin extends through the inner casing and the outer casing and supports the inner casing relative to the outer casing. The bolt passes through the opening defined by the pin.

20 Claims, 6 Drawing Sheets

TURBINE CASING ASSEMBLY MOUNTING PIN

FIELD OF THE INVENTION

The present invention generally involves a turbine casing assembly mounting pin and method for utilizing the same. In particular embodiments, a mounting pin joins an inner casing with an outer casing in a manner that reduces distortion and eccentricity between the inner and outer casings while transferring torque and gravity loads.

BACKGROUND OF THE INVENTION

Conventional turbine casings may include one or more outer turbine casings that surround one or more inner turbine casings. The outer turbine casing is often split into two hemispherical casings bolted together by flanges on a horizontal plane to facilitate maintenance and repair. The inner turbine casing is often supported through to the outer turbine casing by one or more axially spaced circumferential arrays of pins.

Generally, active clearance controls are employed to radially displace inner and outer turbine casings from one another during transient turbine operations. This has the effect of controlling tip clearance between buckets and shrouds, which can be beneficial since decreasing tip clearance improves turbine performance by reducing tip leakage as long as bucket tips are prevented from transiently contacting and thereby rubbing shrouds.

With both active and passive systems in many configurations relative movement occurs between the inner and outer turbine casings due to differential thermal growth of their respective components. The aforementioned pins which are used to join the outer turbine casing with the inner turbine casing tangentially can reduce eccentricity caused by the relative movement. However, such pins can affect outer casing bolt spacing if the primary vertical support pins are placed near a preferred center-line supported configuration and thus intersect the outer casing bolted flange. Wider bolt spacing at the pinned locations can lead to horizontal joint overboard leakage and thus performance degradation.

Thus, a need exists for pins that allow for mounting of an inner turbine casing with an outer turbine casing without impacting outer turbine casing bolt spacing. Methods relating to such pins would also be beneficial.

BRIEF DESCRIPTION OF THE INVENTION

Aspects and advantages of the invention are set forth below in the following description, or may be obvious from the description, or may be learned through practice of the invention.

In certain embodiments of the present disclosure, a turbine casing assembly is described. The turbine casing assembly includes an inner casing and an outer casing surrounding the inner casing. The outer casing has a first outer casing section and a second outer casing section that join together along a flange. A bolt extends through the flange and joins together the first outer casing section and the second outer casing section. The turbine casing assembly further includes a pin. The pin has a segment defining an opening therethrough. The pin extends through the inner casing and the outer casing and supports the inner casing relative to the outer casing. The bolt passes through the opening defined by the pin.

In other embodiments of the present disclosure, a turbine is described. The turbine includes an inner casing and an outer casing. The inner casing carries nozzles and shrouds, the shrouds surrounding tips of buckets carried by a turbine rotor within the inner casing. The outer casing has a first outer casing section and a second outer casing section that join together along a flange. A bolt extends through the flange and joins together the first outer casing section and the second outer casing section. The turbine casing assembly further includes a pin. The pin has a segment defining an opening therethrough. The pin extends through the inner casing and the outer casing and supports the inner casing relative to the outer casing. The bolt passes through the opening defined by the pin.

In still other embodiments of the present disclosure, a method for assembling a turbine casing is described. The method includes joining together an inner casing and an outer casing with a pin, the pin having a segment defining an opening therethrough. The pin extends through the inner casing and the outer casing and supports the inner casing relative to the outer casing. The method further includes joining together a first outer casing section and a second outer casing section with a bolt, the bolt passing through the opening defined by the pin. The inner casing is surrounded with the outer casing.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
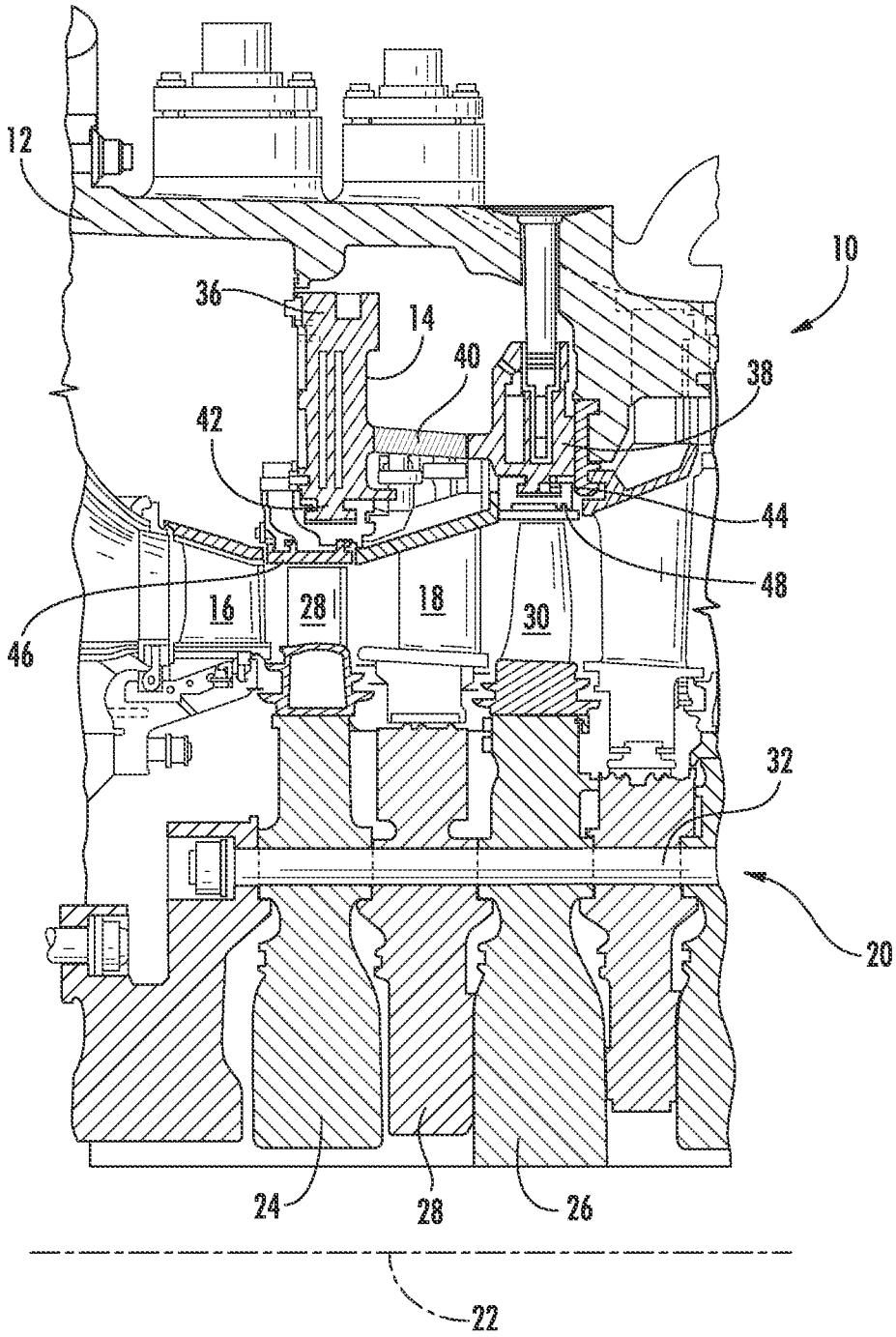
FIG. 1 is a cross-sectional perspective view of a turbine in accordance with certain embodiments of the present disclosure.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof For instance, features illustrated or described as part of one embodiment may be used on another embodiment to yield a still further embodiment. Thus, it is intended that the present invention covers such modifications and variations as come within the scope of the appended claims and their equivalents.

Referring to FIG. 1, there is illustrated a turbine casing assembly 10 cross-section, having an outer structural casing 12 and an inner casing 14 supported by the outer casing 12. The inner casing 14 carries an array of nozzles 16 and 18 forming parts of first and second stages, respectively, of the turbine. The inner casing 14 also surrounds a rotor, generally designated 20, rotatable about an axis 22. The rotor 20 includes circumferential arrays of buckets mounted on wheels arranged alternately with spacers, the wheels and spacers forming the body of the rotor. For example, the first and second-stage wheels 24 and 26 with an intervening spacer 28 are illustrated, the wheels 24 and 26 mounting buckets 28 and 30, respectively. It will be appreciated that the buckets and the nozzles of the various stages in part define the annular hot gas path through the turbine. The wheels and spacers of the rotor are secured to one another by bolts 32 circumferentially spaced one from the other about the rotor.

Figure 2:
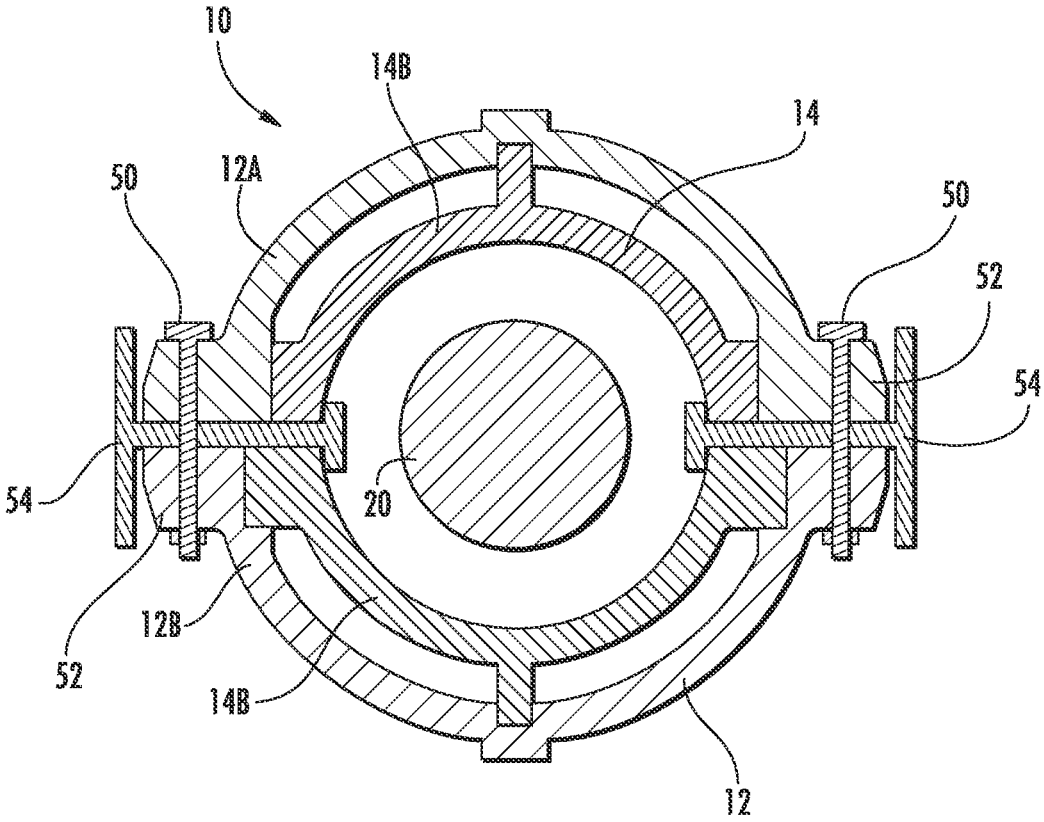
FIG. 2 is a cross-sectional schematic view of the turbine casing shown in FIG. 1 in accordance with certain aspects of the present disclosure.

FIG. 2 illustrates a schematic end view of an assembly 10 according to one embodiment of the present disclosure. The turbine assembly 10 generally includes one or more inner casings 14 and one or more outer casings 12. The one or more inner casings 14 and outer casings 12 are typically fabricated from alloys, superalloys, coated ceramics, or other material capable of withstanding temperatures associated with turbines. For example, a casing for a turbine in a gas turbine system would be fabricated from materials capable of withstanding temperatures associated with nozzle and shroud hook temperatures which are driven by among other factors combustion gases flowing through the gas turbine system.

Referring again to FIG. 1, the inner casing 14 comprises a forward section 36 and an aft section 38 interconnected by an axially extending annular rib 40. The forward and aft sections 36 and 38 are annular and have radially inwardly directed dovetails 42 and 44, respectively, for carrying shrouds 46 and 48. The shrouds provide a minimum clearance with the tips of the buckets. It will be appreciated that the inner casing 14 is secured to the outer casing along radial planes normal to the axis of the rotor and at axial locations, preferably in alignment with the first and second-stage buckets and shrouds.

The outer casing 14 generally surrounds the one or more inner casings 12 and together form the turbine 10. In this manner, the inner casings 12 generally conform to the outer perimeter of the rotating component, and the outer casing 14 provides an enclosure around the rotating component.

Referring again to FIG. 2, there is schematically illustrated a cross-sectional view of turbine 10 comprised of upper and lower outer casing casings 125 and 126 respectively, upper and lower inner casing casings 145 and 146 respectively and a rotor 20. One or more bolts 50 secure the upper and lower outer casing casings 125 and 126 to one another along a flange 52 that can extend across a section of the horizontal midline on either side of the turbine 10. With reference to bolts 50, as used herein, the term "bolts" refers to any structures such as a bolts, studs, pins, or the like that are positioned in flange bolt opening.

To connect support the inner casing relative to the and outer casings casing to one another, one or more pin assemblies 54 pass through the outer casing 12 for connection with the inner casing 14. For instance, the pin assemblies can pass through flange 52 of outer casing 12. One or more pin assemblies 54 can be spaced along each flange 52 that extends across a section of the horizontal midline on either side of the turbine 10.

Figure 3A:
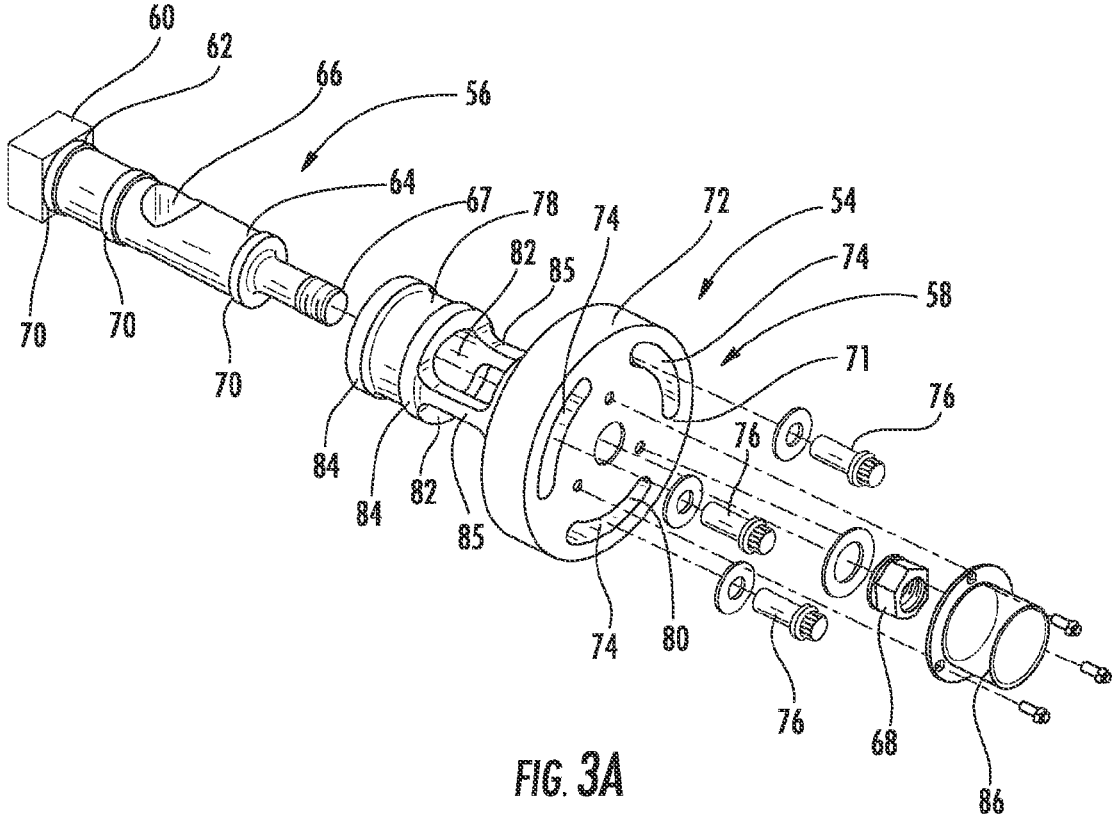
FIGS. 3A-3C illustrate a pin assembly in accordance with certain aspects of the present disclosure.
Figure 3B:
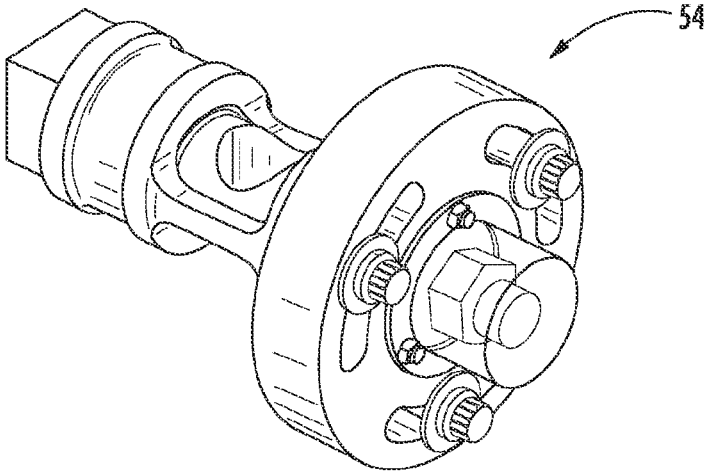
Figure 3C:
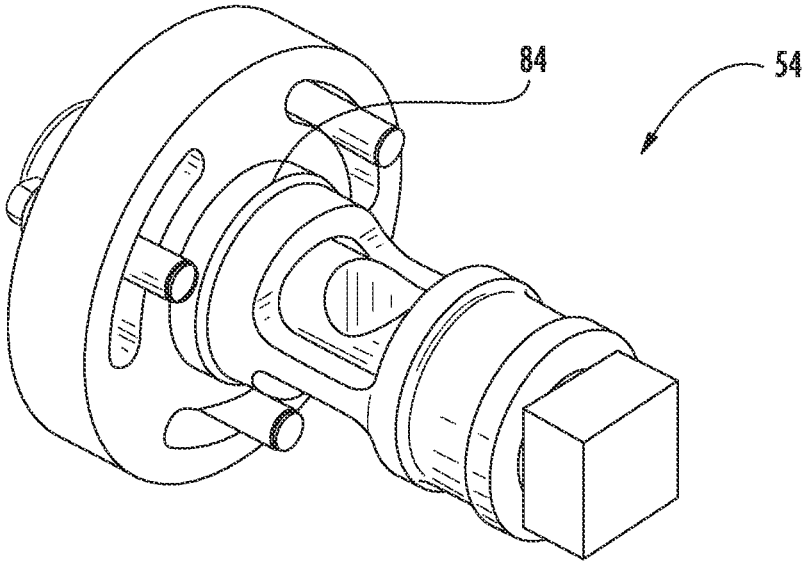

Referring to FIGS. 3A-3C, a pin assembly 54 is illustrated. The pin assembly 54 includes an inner pin portion 56 and an outer pin portion 58. The inner bore of the outer pin is eccentric to the outer diameter of the outer pin. This allows for the outer pin to be rotated and thus change the centerline location of the inner pin. Eccentric pins are often used in turbine systems to allow for precise external alignment capability of the inner casing relative to the rotor Inner pin portion 56 includes an expanded ledge 60 on the radial innermost end 62 of the inner pin portion 56. Ledge 60 can have a generally square shape that interfaces with a complimentary female receiver defined by inner casing (shown in FIG. 2). Bolt section 64 extends from ledge 60 and can be generally cylindrical in shape. Bolt section 64 can include one or more contact pads 70 which allow deterministic loading with outer pin portion 58. Bolt section 64 defines an opening 66 to accommodate a bolt being located therein as will be further described herein. The outermost end 67 of inner pin portion 56 can define threads to receive an inner nut 68.

Outer pin portion 58 includes an enlarged head 71 having a bolt circle 72 with one or more circumferentially defined bolt openings 74. Bolt circle further defines an opening 80 that outermost end 67 of inner pin portion 56 can extend through. The bolt openings can be configured to receive one or more bolts 76 that react out pin rotation through friction which can set alignment of inner and outer turbine casings. Alignment portion 78 extends from bolt circle 72 and defines an opening (not shown) in communication with bolt circle opening 80 which can receive inner pin portion and also allow for outer pin rotations after assembly within the alignment requirements of the unit. Alignment portion includes contact pads 84 that allow deterministic loading with the inner and outer turbine casings and which are generally aligned with contact pads 70 of inner pin portion. Alignment portion includes one or more alignment scallops 82 which permit pin assembly 54 to be located around a bolt as will be further described herein. Alignment scallops 82 are defined, in part, by ridge portions 85 that define openings that are greater than the diameter of opening 66 of bolt section 64 to allow for outer pin rotations and subsequent inner pin eccentricity after assembly during unit alignment. In this manner, alignment portion 78 does not obstruct the bolt that passes through opening 66 and secures the upper and lower outer casing casings.

When assembled, inner pin portion 56 can interface with an inner casing section and be joined to outer pin portion 58 which contacts outer casing through the outer casing flange. Inner nut 68 can secure inner pin portion 56 to outer pin portion 58 and can be covered by a bore cap 86 which is secured to bolt circle 72.

Figure 4:
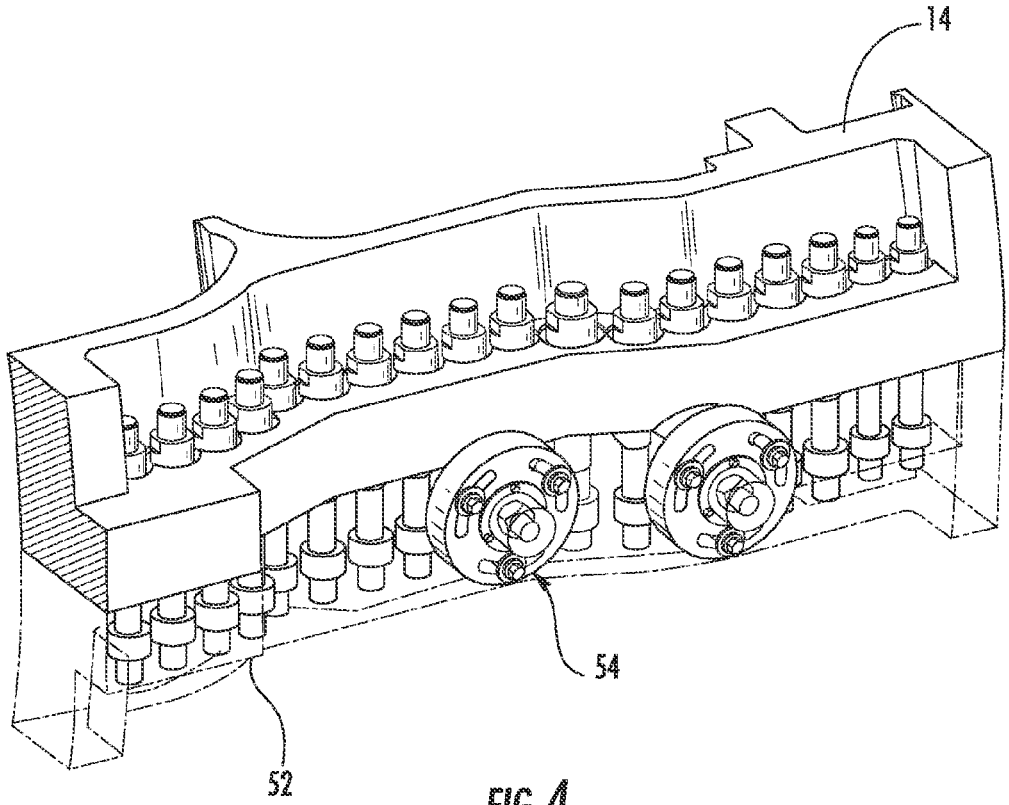
FIG. 4 illustrates a perspective view of a pin assembly surrounding a bolt in accordance with certain aspects of the present disclosure.
Figure 5:
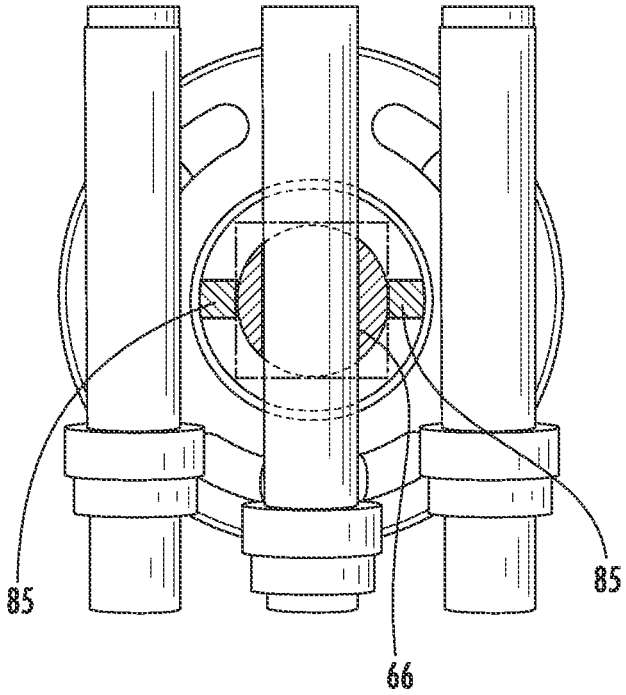
FIG. 5. illustrates a perspective view of a pin assembly surrounding a bolt in accordance with certain aspects of the present disclosure.

As illustrated in FIGS. 4 and 5, pin assembly 54 can be utilized for mounting and/or alignment of an inner turbine casing (not shown) through a horizontal joint flange 52 of outer turbine casing 14 without impacting outer casing bolt spacing and/or leakage. For instance, as can be seen from FIG. 5, which represents a view in which the inner turbine casing and outer turbine casing are not shown, opening 66 and ridge portions 85 permit pin assembly to be located around bolt 50 which is utilized to secure the upper and lower outer casing casings.

One of ordinary skill in the art will readily appreciate that the structure previously described with respect to FIGS. 1-5 provides a method for assembling a turbine 10. The method generally includes joining the inner casing and the outer casing together with a pin assembly as described herein. A first outer casing section and a second outer casing section are joined together with a bolt. The inner casing is surrounded with the outer casing.

Empirical testing and computer-generated models indicate that various embodiments of the present disclosure can one or more benefits over existing turbine casing assembly mechanisms and methods. The pin assemblies described herein can provide a convenient and reliable structure for ensuring the inner casings 12 are concentrically attached to the outer casing 14 during assembly without impacting casing bolt spacing and/or leakage.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A turbine casing assembly comprising:

an inner casing;

an outer casing surrounding the inner casing, wherein the outer casing comprises a first outer casing section and a second outer casing section that join together along a flange;

a bolt extending through the flange and joining together the first outer casing section and the second outer casing section; and a pin, the pin comprising a segment defining an opening therethrough, the pin extending through the inner casing and the outer casing and supporting the inner casing relative to the outer casing, the bolt passing through the opening defined by the pin.

2. A turbine casing assembly as in claim 1, wherein the pin further comprises an inner pin and an outer eccentric pin, the inner pin defining the opening, the outer pin configured to house at least a portion of the inner pin.

3. A turbine casing assembly as in claim 2, wherein the outer pin is configured to surround a portion of the inner pin.

4. A turbine casing assembly as in claim 2, wherein the outer pin can rotate in relation to the inner pin.

5. A turbine casing assembly as in claim 2, wherein the inner pin further comprises a contact pad which contacts the outer pin.

6. A turbine casing assembly as in claim 5, wherein the outer pin further comprises a contact pad, the outer pin contact pad being generally aligned with the inner pin contact pad, the outer pin contact pad contacting the turbine casing.

7. A turbine casing assembly as in claim 1, wherein the outer pin defines an opening having a length that is at least the diameter of the opening defined by the inner pin.

8. A turbine casing assembly as in claim 1, wherein the inner casing comprises a first inner casing and a second inner casing that join together along a flange.

9. A turbine comprising:

an inner casing, the inner casing carrying nozzles and shrouds, the shrouds surrounding tips of buckets carried by a turbine rotor within the inner casing;

an outer casing surrounding the inner casing, wherein the outer casing comprises a first outer casing section and a second outer casing section that join together along a flange;

a bolt extending through the flange and joining together the first outer casing section and the second outer casing section; and a pin, the pin comprising a segment defining an opening therethrough, the pin extending through the inner casing and the outer casing and supporting the inner casing relative to the outer casing, the bolt passing through the opening defined by the pin.

10. A turbine as in claim 9, wherein the pin further comprises an inner pin and an outer pin, the inner pin defining the opening, the outer pin configured to house at least a portion of the inner pin.

11. A turbine as in claim 10, wherein the outer pin is configured to surround a portion of the inner pin.

12. A turbine as in claim 10, wherein the outer pin can rotate in relation to the inner pin.

13. A turbine as in claim 10, wherein the inner pin further comprises a contact pad which contacts the outer pin.

14. A turbine as in claim 13, wherein the outer pin further comprises a contact pad, the outer pin contact pad being generally aligned with the inner pin contact pad, the outer pin contact pad contacting the turbine casing.

15. A turbine as in claim 9, wherein the outer pin defines an opening having a length that is at least the diameter of the opening defined by the inner pin.

16. A turbine as in claim 9, wherein the inner casing comprises a first inner casing and a second inner casing that join together along a flange.

17. A method for assembling a turbine casing comprising:

a. joining together an inner casing and an outer casing with a pin, the pin comprising a segment defining an opening therethrough, the pin extending through the inner casing and the outer casing and supporting the inner casing relative to the outer casing;

b. joining together a first outer casing section and a second outer casing section with a bolt, the bolt passing through the opening defined by the pin; and c. surrounding the inner casing with the outer casing.

18. A method as in claim 17, wherein the pin further comprises an inner pin and an outer pin, the inner pin defining the opening, the outer pin configured to house at least a portion of the inner pin.

19. A method as in claim 18, wherein the outer pin is configured to surround a portion of the inner pin.

20. A method as in claim 17, wherein the outer pin defines an opening having a length that is at least the diameter of the opening defined by the inner pin.

* * * * *

UNITED STATES PATENT AND TRADEMARK OFFICE

CERTIFICATE OF CORRECTION

PATENT NO. : 8,864,459 B2
APPLICATION NO. : 13/226847
DATED : October 21, 2014
INVENTOR(S) : Casavant et al.

It is certified that error appears in the above-identified patent and that said Letters Patent is hereby corrected as shown below:

In the Specification,

In Column 2, Line 60, delete "thereof For" and insert -- thereof. For --, therefor.

In Column 4, Line 2, delete "rotor Inner" and insert -- rotor. Inner --, therefor.

Signed and Sealed this
Nineteenth Day of May, 2015

Michelle K. Lee

Michelle K. Lee
*Director of the United States Patent and Trademark Office*